US009801773B2

(12) United States Patent
Rocklin

(10) Patent No.: US 9,801,773 B2
(45) **Date of Patent: *Oct. 31, 2017**

(54) HIP TRACTION DEVICE AND METHODS

(76) Inventor: Tony Rocklin, Portland, OR (US)

( * ) Notice: Subject to any disclaimer, the term of this patent is extended or adjusted under 35 U.S.C. 154(b) by 57 days.

This patent is subject to a terminal disclaimer.

(21) Appl. No.: 12/911,659

(22) Filed: Oct. 25, 2010

(65) Prior Publication Data

US 2011/0112455 A1 May 12, 2011

Related U.S. Application Data

(60) Provisional application No. 61/260,702, filed on Nov. 12, 2009.

(51) Int. Cl.
*A61H 1/02* (2006.01)

(52) U.S. Cl.
CPC ..... *A61H 1/0218* (2013.01); *A61H 1/0222* (2013.01); *A61H 1/0244* (2013.01); *A61H 2201/018* (2013.01); *A61H 2201/0161* (2013.01); *A61H 2201/0184* (2013.01); *A61H 2201/1246* (2013.01); *A61H 2201/1253* (2013.01); *A61H 2201/1642* (2013.01); *A61H 2201/1664* (2013.01); *A61H 2201/5007* (2013.01); *A61H 2201/5012* (2013.01); *A61H 2201/5038* (2013.01); *A61H 2201/5071* (2013.01); *A61H 2201/5097* (2013.01); *A61H 2203/0437* (2013.01); *A61H 2203/0493* (2013.01)

(58) Field of Classification Search
CPC ..... A61H 1/0218
USPC ..... 602/1, 60, 41, 61–62, 27–40; 482/79, 482/142, 148, 70–72, 146–147
See application file for complete search history.

(56) References Cited

U.S. PATENT DOCUMENTS 2,924,214 A * 2/1960 Zak ..... A61H 1/0259 482/80
4,407,277 A 10/1983 Ellison
(Continued)

FOREIGN PATENT DOCUMENTS

GB 862277 A 3/1961
WO WO 91/06264 5/1991
(Continued)

OTHER PUBLICATIONS

MacDonald, Cameron W. et al.; Clinical Outcomes Following Manual Physical Therapy and Exercise for Hip Osteoarthritis: A Case Series; Journal of Orthopedic & Sports Physical Therapy; Aug. 2006; pp. 588-599; vol. 36; No. 8.
(Continued)

*Primary Examiner* — Tarla Patel
(74) *Attorney, Agent, or Firm* — Thorpe North and Western, LLP; David W. Osborne

(57) ABSTRACT

A hip traction device and associated methods is disclosed. Such a device may include a base having a proximal end and a distal end, a guide coupled to the base, a carrier configured to move along the guide, a tensioner coupled to the base and configured to provide a force to the carrier to move the carrier toward the distal end of the base, causing a leg to be put in tension, and a single body coupling mechanism being removably attached to the carrier and being configured to securely attach to a lower portion of a leg when the body coupling mechanism is detached from the carrier.

23 Claims, 5 Drawing Sheets

(56) References Cited

U.S. PATENT DOCUMENTS

| | | | | |
|---|---|---|---|---|
| 4,621,620 | A | 11/1986 | Anderson | |
| 4,665,899 | A | 5/1987 | Farris et al. | |
| 4,680,309 | A | 7/1987 | Maurer | |
| 5,052,375 | A | 10/1991 | Stark | |
| 5,279,530 | A | 1/1994 | Hess | |
| 5,368,546 | A | 11/1994 | Stark | |
| 5,399,147 | A * | 3/1995 | Kaiser | A61H 1/0255 601/16 |
| 5,484,389 | A | 1/1996 | Stark | |
| 5,499,958 | A * | 3/1996 | Hess | A63B 21/0552 482/123 |
| 5,608,934 | A | 3/1997 | Torrie | |
| 5,901,581 | A | 5/1999 | Chen et al. | |
| 6,056,675 | A | 5/2000 | Aruin | |
| 6,456,884 | B1 | 9/2002 | Kenney | |
| 6,595,904 | B1 | 7/2003 | Staffa | |
| 6,726,642 | B2 * | 4/2004 | Danielsson | A61B 5/0555 601/34 |
| 7,087,030 | B2 | 8/2006 | Wang | |
| 7,364,560 | B2 | 4/2008 | Wang | |
| 7,947,006 | B2 * | 5/2011 | Torrie | A61G 13/0036 128/845 |
| 2003/0199792 | A1 | 10/2003 | Austin | |
| 2004/0054309 | A1 | 3/2004 | Wang | |
| 2004/0167451 | A1 | 8/2004 | Wang | |
| 2005/0178393 | A1 | 8/2005 | Bentley, II | |
| 2006/0100562 | A1 | 5/2006 | Pamplin | |
| 2007/0161935 | A1 | 7/2007 | Torrie et al. | |
| 2007/0265635 | A1 | 11/2007 | Torrie | |
| 2007/0287936 | A1 | 12/2007 | Matsushita et al. | |
| 2008/0161733 | A1 | 7/2008 | Einav | |
| 2008/0214976 | A1 * | 9/2008 | Memminger | A61G 13/0036 602/39 |
| 2008/0280738 | A1 | 11/2008 | Brennan | |
| 2009/0137369 | A1 * | 5/2009 | Branch | A61H 1/0259 482/112 |
| 2009/0187127 | A1 * | 7/2009 | Buckman | A61F 5/05816 602/13 |

FOREIGN PATENT DOCUMENTS

| | | |
|---|---|---|
| WO | WO 2007/022562 | 3/2007 |
| WO | WO 2008/150731 | 12/2008 |
| WO | WO 2009/020651 | 2/2009 |

OTHER PUBLICATIONS

Byrd, J.W. Thomas; Hip Arthroscopy Principles and Application; Hip Series Technique Guide; Smith & Nephew Endoscopy Division; © 2001, 2006; pp. 1-12.

PCT Application PCT/US2010/053985; filed Oct. 25, 2010; Tony Rocklin; International Search Report mailed Aug. 18, 2011.

EP Application 10830421.3; Date Sep. 19, 2012; Tony Rocklin; European Search Report dated Mar. 14, 2014.

U.S. Appl. No. 13/469,889, filed May 11, 2012; Tony Rocklin; office action dated Oct. 27, 2014.

* cited by examiner

HIP TRACTION DEVICE AND METHODS

PRIORITY DATA

This application claims the benefit of U.S. Provisional Patent Application Ser. No. 61/260,702, filed on Nov. 12, 2009, which is incorporated herein by reference.

FIELD OF THE INVENTION

The present invention relates generally to traction devices and associated methods. Accordingly, the present invention involves the mechanical arts and medical arts fields.

BACKGROUND OF THE INVENTION

Traction, generally, is the application of a force to stretch or distract a particular part of the body in a specific direction. Traction of a hip joint, more specifically known as the femoral-acetabular joint, may be utilized to assist treatment of a dislocated or broken hip, degenerative joint disease or osteoarthritis of the hip, post-surgical mobilization of the hip joint in cases such as resurfacing or labral repair, and any other condition of the hip when compression or restriction of movement is present. A purpose of hip traction may be to stretch and mobilize the soft tissues around the hip to allow the femoral head to move back into, or more properly within, the hip socket or acetabulum. Traditionally, traction has been applied to a hip by attaching one end of a rope to a person's lower leg and using weights to apply a force to the other end of the rope. A frame positioned over the leg provides a way to suspend and elevate the leg to a proper hip flexion angle. The frame also provides a pulley mounting location for hanging the weight from the frame. In addition, medical and osteopathic physicians, physical therapists, chiropractors, and other health care providers have used their hands to manually apply the traction force in a clinical setting.

This traditional traction arrangement has proven to be cumbersome. For example, set-up can require selecting weights from an inventory of weights and then attaching the appropriate combination to the rope depending on the length and weight of each leg. Set-up can also require assembling multiple parts attached to frames around the patient, which can require the involvement of multiple individuals. In many cases, it can take much more time to set-up for traction than is required to perform the actual treatment.

Moreover, applying traction in a duty cycle is not easy with the traditional traction arrangement. A traction duty cycle may include a period of time when force is applied followed by a period of time when no force is applied. With the traditional traction arrangement, this requires someone (other than the patient) to regularly attach and remove the weights from the end of the rope. This is a costly and inefficient use of time.

Having a medical provider, such as a physical therapist, apply the traction manually is very effective and may likely be the gold standard of hip traction. However, as mentioned above, this can require another individual to apply the traction and the patient usually must be in a clinical setting. For many, this is not feasible on a daily basis and can get expensive for both the patient and the patient's insurance company. Thus, there is a need for a hip joint traction device that a patient can use without another's assistance and in a setting away from a clinic or hospital.

SUMMARY OF THE INVENTION

Accordingly, the present invention provides a traction device and associated methods thereof. In one aspect, for example, a hip (femoral-acetabular) joint traction device is provided. Such a device may include a base having a proximal end and a distal end, a guide coupled to the base, a carrier configured to move along the guide, a tensioner coupled to the base and configured to provide a force to the carrier to move the carrier toward the distal end of the base, causing a leg to be put in tension, and a single body coupling mechanism being removably attached to the carrier and being configured to securely attach to a lower portion of a leg when the body coupling mechanism is detached from the carrier.

In some aspects of the present invention, the tensioner includes a pneumatic cylinder. In a specific aspect, the tensioner further includes a pump to pressurize the pneumatic cylinder. In another specific aspect, the pump is a hand pump. In yet another specific aspect, the pump is an electric pump. In still another specific aspect, the hip traction device further includes a controller configured to execute a duty cycle by controlling force amount and/or duration provided by the tensioner to the carrier.

In one aspect of the present invention, the hip traction device further includes a controller configured to execute a duty cycle by controlling force amount and/or duration provided by the tensioner to the carrier.

In some aspects of the present invention, the body coupling mechanism includes a bracket for removably attaching to the carrier and the carrier includes a receiving portion configured to engage with the bracket for removably attaching to the body coupling mechanism. In one specific aspect, the bracket includes a hook and the receiving portion includes a catch configured to engage with the hook. In another specific aspect, the receiving portion includes a hook and the bracket includes a catch configured to engage with the hook.

In one aspect of the present invention, the tensioner provides the force to the carrier via a member in compression. In another aspect, the tensioner provides the force to the carrier via a member in tension. In yet another aspect, the lower portion of a leg to be securely attached includes a foot, ankle, shin, and calf, or combination thereof, and the body coupling mechanism includes a boot, sleeve, sling, strap, or wrap, configured to attach securely to the foot, ankle, shin and calf, or combination thereof. In some specific aspects, the subject's upper leg may also or alternatively be attached with the body coupling mechanism. In this case, wraps, sleeves, slings, straps, and other body coupling mechanisms may be used to effectively couple the upper leg to the carrier. In another specific aspect, the subject's knee may also or alternatively be attached with the body coupling mechanism. In this case, wraps, sleeves, slings, straps, and other body coupling mechanisms may be used to effectively couple the knee to the carrier. In still another aspect, the force provided by the tensioner to the carrier is limited to a predetermined maximum force. In a further aspect, the force provided by the tensioner to the carrier is adjustable.

In some aspects of the present invention, the proximal end of the base is engaged by a user's buttocks. In a specific aspect, the engagement of the proximal end of the base and the user's buttocks is configured to prevent the user's buttocks from moving toward the distal end of the base due to tension in the leg.

In one aspect of the present invention, the base is held in place on a support surface, at least in part, by a user's weight. In another aspect, a portion of the base in contact with a support surface comprises friction-enhancing features. In yet another aspect, the base is at an angle of between 15 and 45 degrees relative to a support surface for a user of the traction device.

In some aspects of the present invention, the traction device includes a cover to protect the hip traction device during transit that at least partially encloses an underside of the base. In a specific aspect, the cover comprises a top cover and a bottom cover. In a more specific aspect, the top cover is integrated with the base.

The present invention additionally provides a method of tractioning. In one aspect, for example, a method of tractioning a hip of a subject is provided. Such a method may include providing a hip traction device as discussed above, attaching the body coupling mechanism to a lower portion of the subject's leg, engaging the proximal end of the base with the subject's buttocks, wherein a portion of the subject's weight in the buttocks is carried by the proximal end of the base, straightening the subject's leg, aligning the subject's leg with the proximal and distal ends of the base, attaching the body coupling mechanism to the carrier, and activating the tensioner to provide a force to move the carrier toward the distal end of the base, causing the subject's leg to be put in tension.

In one aspect of the present invention, the method includes the step of deactivating the tensioner to reduce the force provided to the carrier, allowing the carrier to move toward the proximal end of the base, and causing the subject's leg to be relieved of tension. In another aspect of the present invention, the steps of activating the tensioner and deactivating the tensioner are carried out according to a duty cycle, where activating the tensioner includes providing the force for a predetermined duration and where deactivating the tensioner includes reducing the force for a predetermined duration.

There has thus been outlined, rather broadly, various features of the invention so that the detailed description thereof that follows may be better understood, and so that the present contribution to the art may be better appreciated. Other features of the present invention will become clearer from the following detailed description of the invention, taken with the accompanying claims, or may be learned by the practice of the invention.

DETAILED DESCRIPTION OF THE INVENTION

Definitions

Figure 1:
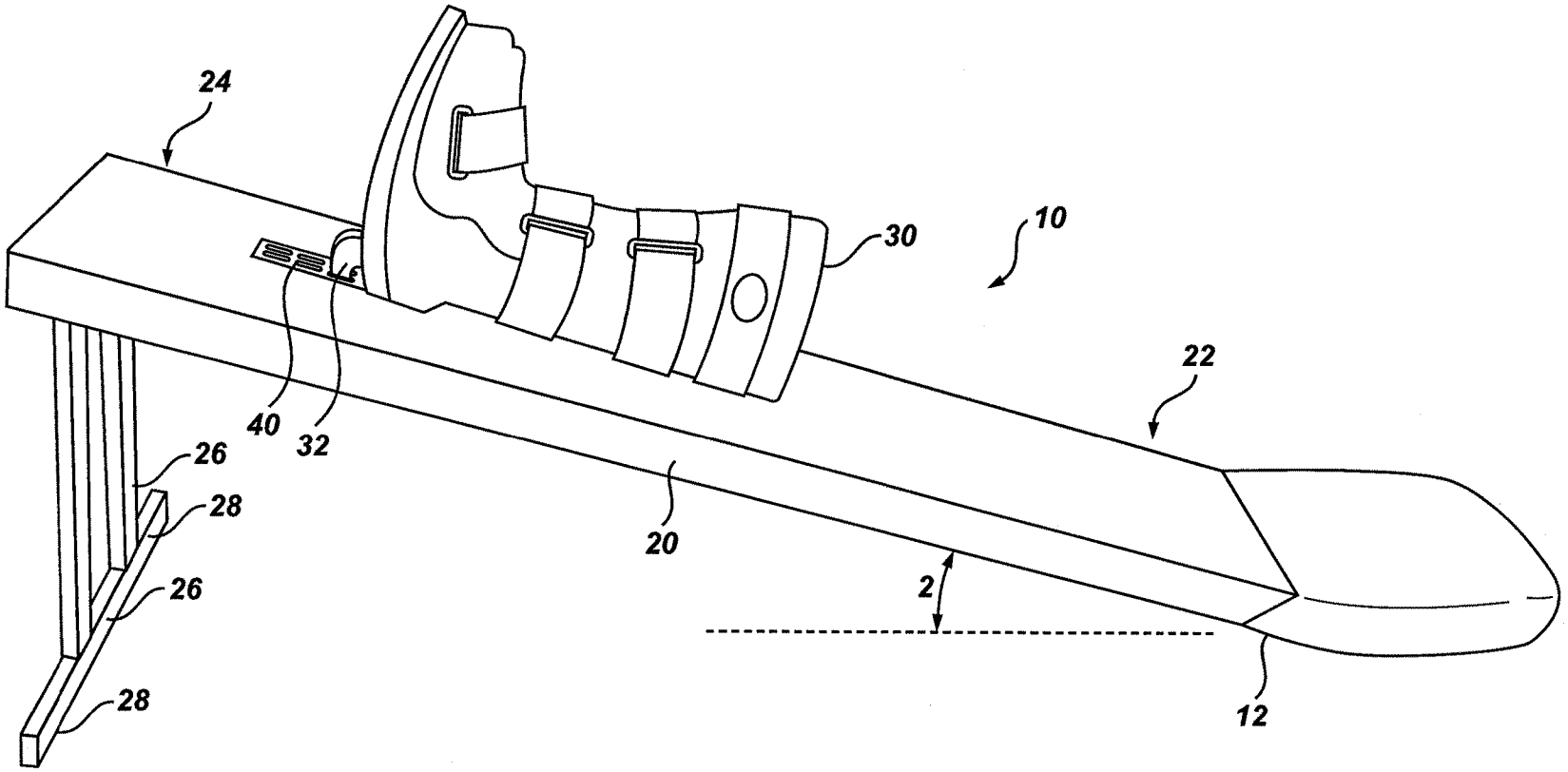
FIG. 1 is a top perspective view of a hip traction device in accordance with an embodiment of the present invention.

In describing and claiming the present invention, the following terminology will be used in accordance with the definitions set forth below.

The singular forms "a," "an," and, "the" include plural referents unless the context clearly dictates otherwise. Thus, for example, reference to "a boot" includes reference to one or more of such boots, and reference to "the attachment" includes reference to one or more of such attachments.

As used herein, the term "about" is used to provide flexibility to a numerical range endpoint by providing that a given value may be "a little above" or "a little below" the endpoint.

As used herein, the term "substantially" refers to the complete or nearly complete extent or degree of an action, characteristic, property, state, structure, item, or result. For example, an object that is "substantially" enclosed would mean that the object is either completely enclosed or nearly completely enclosed. The exact allowable degree of deviation from absolute completeness may in some cases depend on the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result. For example, a composition that is "substantially free of" particles would either completely lack particles, or so nearly completely lack particles that the effect would be the same as if it completely lacked particles. In other words, a composition that is "substantially free of" an ingredient or element may still actually contain such item as long as there is no measurable effect thereof.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 1 to about 5" should be interpreted to include not only the explicitly recited values of about 1 to about 5, but also include individual values and sub-ranges within the indicated range. Thus, included in this numerical range are individual values such as 2, 3, and 4 and sub-ranges such as from 1-3, from 2-4, and from 3-5, etc., as well as 1, 2, 3, 4, and 5, individually. This same principle applies to ranges reciting only one numerical value as a minimum or a maximum. Furthermore, such an interpretation should apply regardless of the breadth of the range or the characteristics being described.

As used herein, the term "hip" refers to an acetabular-femoral joint.

As used herein, the term "straightening a subject's leg" is to be understood as straightening a subject's leg to within about 0 to about 5 degrees of the subject's end range knee extension. End range knee extension may vary from one subject to another. For example, one subject may have an end range knee extension of 0 degrees. In this case, the subject can straighten the leg completely. In another example, a subject may have an end range knee extension of 10 degrees. In this case, the subject is not able to straighten the leg completely. Thus, "straightening a subject's leg" is relative to the particular subject's end range knee extension.

The Invention

The present invention relates to a hip traction device and associated methods. With reference to FIG. 1, illustrated is a top perspective view of an embodiment of a hip traction device 10. A hip traction device 10 may include a base 20 having a proximal end 22 and a distal end 24. A base 20 may include a support 26 located at a distal end 24 of the base 20. At a proximal end 22, a base 20 may be configured to engage with a user's buttock such as with a seat 12. This engagement with the base 20, with or without a seat 12, may be such that a user's buttock is prevented from moving or sliding toward a distal end 24 of a base 20 when the user's leg is put in tension by the traction device 10. For example, a base 20 may have a shoulder, bump, or other feature to engage with a user's buttock that may prevent a user from sliding toward a distal end 24. Moreover, the base 20 may include a material of a high frictional coefficient, such as a rubber, etc., to provide frictional forces that prevent or reduce the slide of a user's buttock toward the distal end 24. Thus, a user does not require attachment to a base 20 in the hip or buttock region to prevent sliding toward a distal end 24 during tractioning. In some aspects, the downward force exerted by the weight of a user by the user's buttock resting on the proximal end of the base may be sufficient to reduce or prevent movement of the buttock toward the distal end 24 of the base 20 during tractioning. In some regards, the geometry created by the position of the user's buttock and leg in combination with the floor or other flat surface upon which the user and the device of the present invention rests may aid in, or be sufficient in and of itself, to reduce or prevent movement of the user's buttock toward the distal end 24 of the base 20 during tractioning of the hip. Specifically, such a geometric configuration is that of an angle, or "wedge" with a vertex being created at the interface between a user's buttock and the ground or other flat surface upon which the user and device of the present invention rests. This angle or wedge acts to trap and secure the proximal end 22 of the base 20 during tractioning.

As previously stated, the base 20 may be held in place on a support surface, at least in part, or substantially in entirety, by a user's weight. To facilitate putting a user's leg in tension, a hip traction device 10 may further include a body coupling mechanism 30. A body coupling mechanism 30 may be configured to attach securely to a user's leg. When a hip traction device 10 is operated, because a user's buttock may be prevented from moving toward a distal end 24 of a base 20, the user's leg may be put in tension via its attachment to a body coupling mechanism 30. Thus, a user need only be attached to a hip traction device 10 in a single location (i.e. a portion of the leg), and there is no need for a mechanism which secures the hips, pelvis, lumbar spine, thorax, or upper body to the proximal end 22 of the base 20.

A base 20 of a hip traction device 10 may be at an angle 2 relative to a support surface for a user. An angle 2 may be variable or fixed. An angle 2 may be selected to provide a hip flexion angle of between about 0 and about 45 degrees. This is regarded as a suitable range of hip flexion angles for tractioning a hip. Hip flexion angle, and how it is determined, is known in the medical arts as the "loose-pack or open pack position." Generally, an angle 2 may be between about 15 and about 45 degrees, depending on the individual. In a more specific aspect, an angle 2 may be between about 15 and about 30 degrees.

Figure 2:
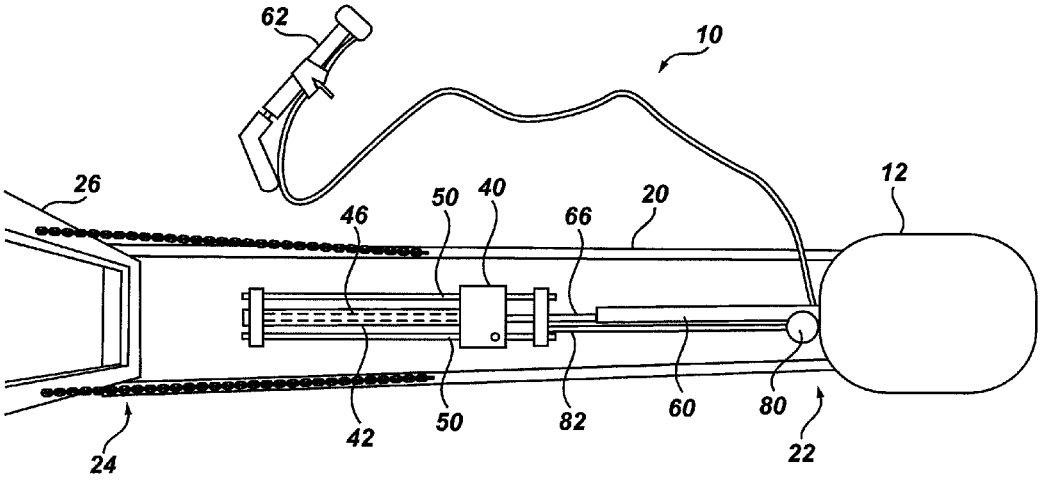
FIG. 2 is a bottom view of a hip traction device in accordance with an embodiment of the present invention.

With reference to FIG. 2, and continued reference to FIG. 1, illustrated is a bottom view of an embodiment of a hip traction device 10. From this view, it is shown that a hip traction device 10 may include a guide 50 coupled to a base 20. A hip traction device 10 may further include a carrier 40 that may be configured to move along a guide 50. Additionally, a hip traction device 10 may include a tensioner 60 coupled to a base 20. A tensioner 60 may be configured to provide a force to the carrier 40. A carrier 40 may comprise a receiving portion 42 configured to engage, for removable attachment, with a body coupling mechanism 30. A force provided by a tensioner 60 may move the carrier 40 toward a distal end 24 of a base 20. A body coupling mechanism 30 may be removably attached to a carrier 40 by coupling with a catch 46. Further, a body coupling mechanism 30 may be attached to a user's leg. Thus, movement of a carrier 40 toward a distal end 24 of a base 20 may cause a body coupling mechanism 30 to move in the same direction. As mentioned above, when a body coupling device is coupled to a user's leg, this movement may cause a user's leg to be put in tension. Thus, in this configuration, tension in the user's leg can cause the hip or acetabular-femoral joint to be put in traction.

A body coupling mechanism 30 may be securely attached to a portion of a user's leg, such as an upper leg portion, a lower leg portion, or a combination thereof, when the body coupling mechanism 30 is detached from the carrier 40. This may enable a user to fit and attach a body coupling mechanism 30 to a portion of a leg (i.e. a foot, ankle, calf, knee, thigh, or combination thereof) in a position that is easier and more comfortable than when the body coupling mechanism 30 is attached to a carrier 40. The body coupling mechanism 30 can include a boot, shoe, sleeve, sling, strap, or wrap configured to attach securely to the foot, ankle, calf, knee, thigh, or combination thereof. In one embodiment, a body coupling mechanism 30 may comprise a boot configured to attach securely to a foot or a foot and ankle simultaneously. A boot may comprise straps secured by hook and loop fasteners, buckles, laces, etc. suitable to secure a boot about a foot. In another embodiment, a body coupling mechanism 30 may comprise a harness configured to attach securely to an ankle. An ankle harness may comprise straps secured by hook and loop fasteners, buckles, laces, etc. suitable to secure an ankle.

A tensioner 60 can be disposed anywhere relative to the base 20, such as at a proximal end 22, a distal end 24, or somewhere in between. Furthermore, the tensioner 60 can be configured to "push" or "pull" a carrier 40. Thus, numerous possibilities exist for configuring the tensioner 60 on the base 20 to move the carrier 40.

For example, the tensioner 60 can transfer force to move the carrier 40 via a rigid member 66, such as a beam, rod, strut, etc. In the example shown, the tensioner 60 causes the carrier 40 to move toward the distal end 24 of the base 20 by imparting a compressive (pushing) force on the carrier 40. In other embodiments of a rigid coupling between the tensioner 60 and carrier 40, the tensioner 60 can cause the carrier 40 to move toward the distal end 24 by a tensile (pulling) force. Thus, with a rigid coupling between the tensioner 60 and the carrier 40, the tensioner 60 can be located at the proximal end 22, the distal end 24, or anywhere in between. If the tensioner 60 is located at the proximal end 22, then the tensioner 60 can be configured to push the carrier 40 toward the distal end 24 to put the leg in tension. On the other hand, if the tensioner 60 is located at the distal end 24, then the tensioner 60 can be configured to pull the carrier 40 toward the distal end 24 to put the leg in tension. In one aspect, the tensioner 60 can be coupled to the carrier 40 via a gear, such as a rack and pinion. For example, the tensioner 60 can rotate the pinion gear and the carrier 40 can be coupled to the rack gear. In this way, the tensioner 60 can push and/or pull the carrier 40 via the rack and pinion gear. In a particular aspect of a rigid coupling between the tensioner 60 and carrier 40, the rigid member, such as a rod, can comprise the carrier 40, such that the body coupling mechanism 30 can be configured to couple directly to the rigid member. The coupling between the carrier 40 and body coupling mechanism 30 is discussed further below.

In another example, the tensioner 60 can transfer force to move the carrier 40 via a flexible member (not shown), such as a cable, chain, rope, etc. In other words, with a flexible coupling between the tensioner 60 and carrier 40, the tensioner 60 can cause the carrier 40 to move toward the distal end 24 by a tensile (pulling) force. With a flexible coupling to the carrier 40, the tensioner 60 can be located at the proximal end 22, the distal end 24, or anywhere in between. If the tensioner 60 is located at the distal end 24, then the tensioner 60 can be configured to pull the carrier 40 toward the distal end 24 to put the leg in tension. On the other hand, if the tensioner 60 is located at the proximal end 22, then a pulley or cog located toward the distal end 24 relative to the carrier 40, can direct a flexible member to pull the carrier 40 toward the distal end 24. For example, a cable may extend from the tensioner 60 to the pulley, where the cable is redirected back to the carrier 40, thus causing the tensioner 60 to pull the carrier 40 toward the distal end 24. Alternatively, the cable and pulley can be substituted with a chain and cog, respectively. In one aspect of this embodiment, the tensioner 60 can be coupled to the carrier 40 via a gear or cog that drives a flexible member, such as a chain. For example, the tensioner 60 can rotate the gear or cog and the carrier 40 can be coupled to the flexible member. In this way, the tensioner 60 can pull the carrier 40 via the flexible member that is driven by the gear or cog. In a particular aspect of a flexible coupling between the tensioner 60 and carrier 40, the flexible member, such as a chain, can comprise the carrier 40, such that the body coupling mechanism 30 can be configured to couple directly to the flexible member. The coupling between the carrier 40 and body coupling mechanism 30 is discussed further below.

In yet another example, the tensioner 60 can transfer force to move the carrier 40 via a combination of rigid and flexible members (not shown). Due to the presence of a flexible member, this configuration is best suited to move the carrier 40 toward the distal end 24 by a tensile (pulling) force.

It should be understood that the exact relationship of the tensioner 60 and carrier 40 relative to the proximal end 22 and distal end 24, regardless of whether the tensioner 60 pushes or pulls the carrier 40, can vary depending on space constraints presented by the base 20 and the particular type of tensioner 60 and carrier 40, and the coupling of the tensioner 60 and the carrier 40.

A tensioner 60 may be configured to provide a force to a carrier 40 by a variety of different means. For example, a tensioner 60 may comprise a pneumatic piston/cylinder or a hydraulic piston/cylinder. A piston/cylinder can be configured to push and/or pull the carrier 40. A tensioner 60 may further comprise a pump to pressurize a pressurized medium in a cylinder, such as air or a hydraulic fluid, as the case may be, to move a piston in the cylinder. A pump may be operated by hand, such as a hand pump 62, or it may be a powered pump, such as by a motor energized by electricity or fuel. In one embodiment, a pump can comprise a bellows. In some embodiments, a tensioner 60 may include or may be powered by a motor, such as an electric or internal combustion motor. In some other embodiments, a tensioner 60 may be human-powered. In another embodiment, the tensioner 60 can comprise a rotatable shaft that delivers a torque to drive a gear or cog. The shaft can be rotated by hand, such as by a crank and/or gear mechanism, or by a motor.

Furthermore, a tensioner 60 may be configured to allow a user of a traction device 10 to control the force provided by the tensioner 60 without relying on another person to control the force. In other words, a hip traction device 10 can include a force adjustability control that is accessible to the user while the user is using and operating the hip traction device 10. This can enable a user of the hip traction device 10 to operate the device without relying on others, such as medical staff, therapists, or family members. This can also be a safety feature that can prevent injury to a user. A force adjustability control can limit pump pressure or torque produced by a tensioner 60. Thus, a force provided by a tensioner 60 to a carrier 40 may be adjustable and/or it may be limited to a predetermined maximum force. Further safety features can include a pressure limiting valve, a clutch set to slip at a given torque, a sensor configured to measure or derive the applied force and an electronic control that monitors the sensor, or any other force limiting safety feature.

A traction device 10 may comprise a carrier return mechanism 80 to return a carrier 40 to an initial position after tensioner 60 ceases providing a force to move the carrier 40 toward the distal end 24 of the base 20. A carrier return mechanism 80 may be configured to provide a force to move a carrier 40 toward a proximal end 22 of the base 20. A carrier return mechanism 80 may be integral to a tensioner 60 or it may be a separate component located in any suitable location on a traction device 10. A carrier return mechanism 80 may transmit a tensile or compressive force to a carrier 40 in order to move it toward a proximal end 24 of a base 20. In one embodiment, a carrier return mechanism 80 may be located near a tensioner 60 and connected to a carrier 40 by a cable 82.

A carrier return mechanism 80 may provide a force passively or actively. A passive force may exist without activation and may be available at any time. For example, a passive force may be provided by a spring, such that movement of a carrier 40 toward a distal end 24 increases force in the spring so that when a tensioner 60 ceases to provide a force, the spring force automatically returns the carrier 40 toward the proximal end 22 of the base 20. In one embodiment, carrier return mechanism 80 may comprise a cable 82 in tension by a spring, which is connected to a carrier 40. In another embodiment, a carrier return mechanism 80 may be integral to a tensioner 60. In this embodiment, a pneumatic cylinder may provide a "negative spring" such that movement of a piston in a tensioner 60 providing force to move a carrier 40 toward a distal end 24 may cause compression of the negative spring, thus increasing force in the negative spring. When the tensioner 60 ceases to provide a force to a carrier 40, the negative spring may provide force to the carrier 40 to move it toward the proximal end 22 of the base 20. An active force may exist without activation and may not always be present. For example, an active force may be provided to pull on a cable or a tether attached to the carrier, to wind a spool or crank, or to operate a pump that directly or indirectly applies force to the carrier. An active force can be supplied by a motor of some type or by a human. In a specific example, an electric motor may be turned on to provide a force to move a carrier 40 toward a proximal end 22 of the base 20 after a tensioner 60 ceases to provide a force.

A base 20 may comprise a support for supporting a traction device 10. A support 26 may determine, in part, the height of a distal end 24 of a base 20 and/or the angle of a base 20 relative to a support surface. For example, a support 26 may telescope to vary the height of a distal end 24 of a base 20. In another example, a support 26 may fold to vary the height of a distal end 24 of a base 20 and to vary the angle of the base 20 relative to a support surface. Alternatively, this angle may be fixed and not variable.

A support 26 may comprise a stabilizer 28. A stabilizer 28 may provide additional lateral support for a traction device resting on a bed, floor, bed side rails, table, or couch. A stabilizer may be fixed in position or it may extend/retract by folding. A support 26 and/or stabilizer 28 may be configured to rest on, or attach to, a bed, floor, bed side rails, table, couch, etc. For example, a support 26 and/or stabilizer 28 may be configured to attach to bed side rails by a clamp, strap, clip, tie, suction device, etc. It should be understood that a stabilizer 28 is not required and a support 26 can include independent support structures uncoupled by a stabilizer.

A base 20 may be held in place on a support surface, at least in part, by a user's weight. For example, a portion of a user's weight in the buttocks region may provide a force to a support surface. This force may be transferred through a portion of a proximal end 22 of a base 20 that is in contact with the support surface. This portion of a base 20 in contact with a support surface may include friction-enhancing features to prevent a base from sliding on a support surface. Thus, the user's weight, at least in part, may hold a base 20 in place on a support surface.

A traction device 10 may be lightweight, foldable, and portable or it may be intended as a permanent or semi-permanent fixture. In one embodiment, a traction device 10 may be incorporated into a table, such that it folds flat into the table's top surface and may be raised to between about 15 and about 35 degrees to allow the device to engage a user at an appropriate hip flexion angle for traction.

Figure 3:
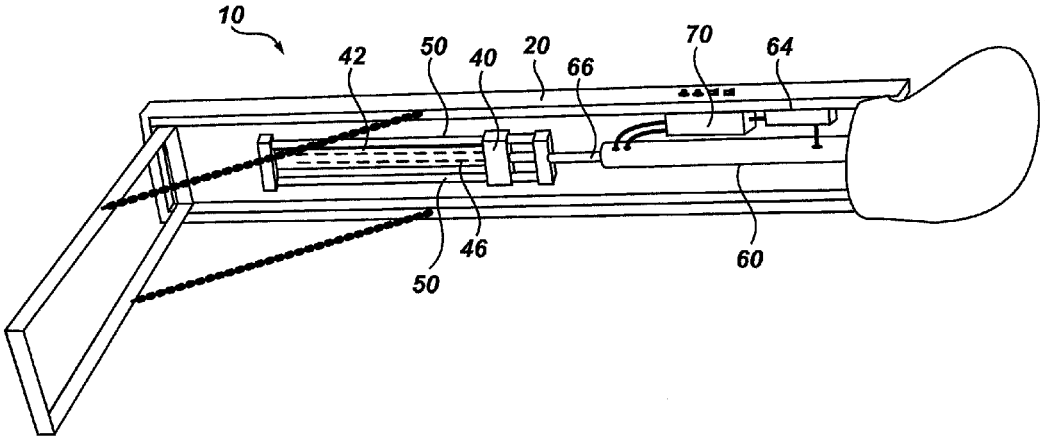
FIG. 3 is a bottom perspective view of a hip traction device in accordance with an embodiment of the present invention.

With reference to FIG. 3, illustrated is a bottom view of another embodiment of a hip traction device 10. From this view, it is shown that a hip traction device 10 may include a controller 70. A controller 70 may be used to control operation of a tensioner 60. For example, a controller 70 may control the amount of force and the duration of force application by a tensioner 60 to a carrier 40. Thus, a controller 70 may be used to execute a duty cycle that may include a period of time when force is applied followed by a period of time when no force is applied. Further, the controller 70 may control the total duration of a treatment, possibly including multiple duty cycles. In one aspect, the controller 70 can control the operation of a motorized pump 64 to cause a piston to move within a cylinder of the tensioner 60.

A controller 70 may be adapted to receive inputs from a user. For example, a controller 70 may include a user interface such as dials, switches, buttons, display screen, LED, speaker, etc. A user interface may enable a user to communicate parameters such as force magnitude and time intervals to a controller 70. In a further example, the controller 70 may communicate with a personal computer via a wired or wireless connection. In one aspect, the personal computer may communicate or dictate control parameters to the controller 70. A controller 70 may communicate information to user by audio and/or visual aspects of a user interface. For example, a warning or alert may include a flashing display and/or a beeping sound to indicate that immediate attention is required. A controller 70 may be positioned to allow a user of a traction device 10 to access its user interface. Thus, a controller 70 may allow a user of a traction device 10 to control the amount of force provided by a tensioner 60 without needing the assistance of another person.

A controller 70 may be adapted to receive input from a pressure sensor associated with a tensioner 60. A pressure sensor may be used to determine the amount of pressure within a pneumatic or hydraulic cylinder. Pressure data may then be used to determine the amount of force exerted by a tensioner 60. Thus, in one embodiment of a traction device 10, a controller 70 may serve to read and control the operation of a tensioner 60 and to control the cyclic application of a force to a carrier 40. A controller 70 may also control the operation of a pressure relief valve to reduce applied force.

A controller 70, which may include a microprocessor and may run software, may control the operation of the tensioner 60. A controller 70 may be programmed to achieve any desired force application and magnitude sequence and timing, including delay intervals, in accordance with clinical application. For example, a controller 70 may be programmed to operate in accordance with a duty cycle. A time interval for force application or a rest period may be programmed or changed independently. A user, such as a patient or a therapist, can control the magnitude of force applied in the treatment at each time interval. A controller 70 may be adapted to receive the user's commands and control the operation of a tensioner 60 to control the cyclic application of force to a carrier 40, such as defined by a duty cycle. A controller 70 may control the operation of a tensioner 60 to provide a force to a carrier 40 for a predetermined time interval. When the operating interval of the tensioner 60 terminates, a controller 70 may de-energize the tensioner 60 and enable a carrier 40 to move toward a proximal end 22 of a base 20.

Figure 4:
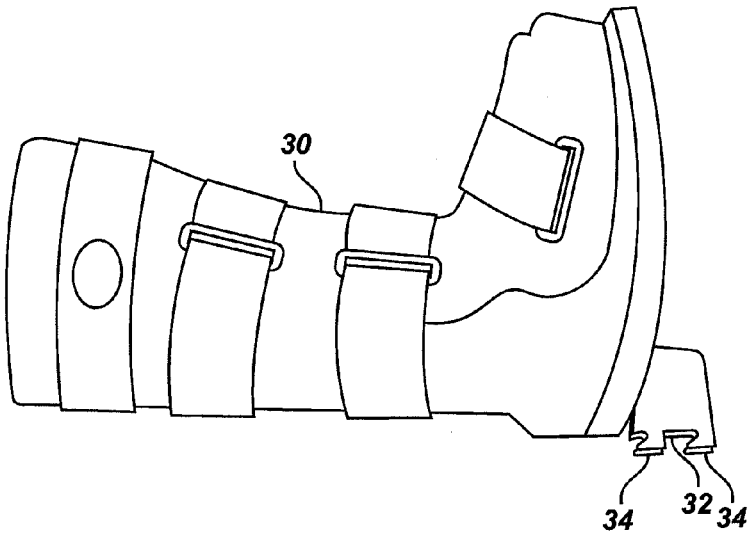
FIG. 4 is a close-up perspective view of a body coupling mechanism in accordance with an embodiment of the present invention.

With reference to FIG. 4, and continuing reference to FIGS. 1-3, a body coupling mechanism 30 may comprise a bracket 32 for removably attaching to a carrier 40. A carrier 40 may comprise a receiving portion 42 configured to engage, for removable attachment, with a body coupling mechanism 30. In one embodiment, a bracket 32 of a body coupling mechanism 30 may removably attach to a receiving portion 42 of a carrier 40. A bracket 32 of a body coupling mechanism 30 may comprise a hook 34 and a receiving portion 42 of a carrier 40 may comprise a catch 46 configured to engage with the hook 34. Alternatively, a receiving portion 42 of a carrier 40 may comprise a hook and a bracket 32 of a body coupling mechanism 30 may comprise a catch configured to engage with the hook.

It should be noted that a carrier 40 may comprise a plurality of receiving portions to removably attach with a body coupling mechanism 30. For example, if a receiving portion comprises a catch, then there may be multiple catches available for engagement with a body coupling mechanism 30. In another example, if a receiving portion comprises a hook, then there may be multiple hooks available for engagement with a body coupling mechanism 30. Multiple receiving portions of a carrier 40 may be in any arrangement that facilitates removable attachment with a body coupling mechanism 30. In this embodiment, the arrangement of receiving portions may provide a convenient attachment location for a variety of user leg lengths, without the need for the user to bend a knee or to move a carrier 40 into position before a body coupling mechanism 30 can attach to a carrier 40. Alternatively, a carrier 40 may comprise only a single receiving portion 42 such as a catch 46 or a hook. In this embodiment, a carrier 40 may be moved into position for attachment with a body coupling mechanism 30. A carrier 40 may be moved by manually pushing/pulling the carrier 40 into position or by activating a tensioner 60 to move the carrier 40 into position. A tensioner 60 may be activated by manually actuating a pump (or motor powering the pump) to pressurize a cylinder or by using a controller 70 to actuate a pump (or motor).

Figure 5:
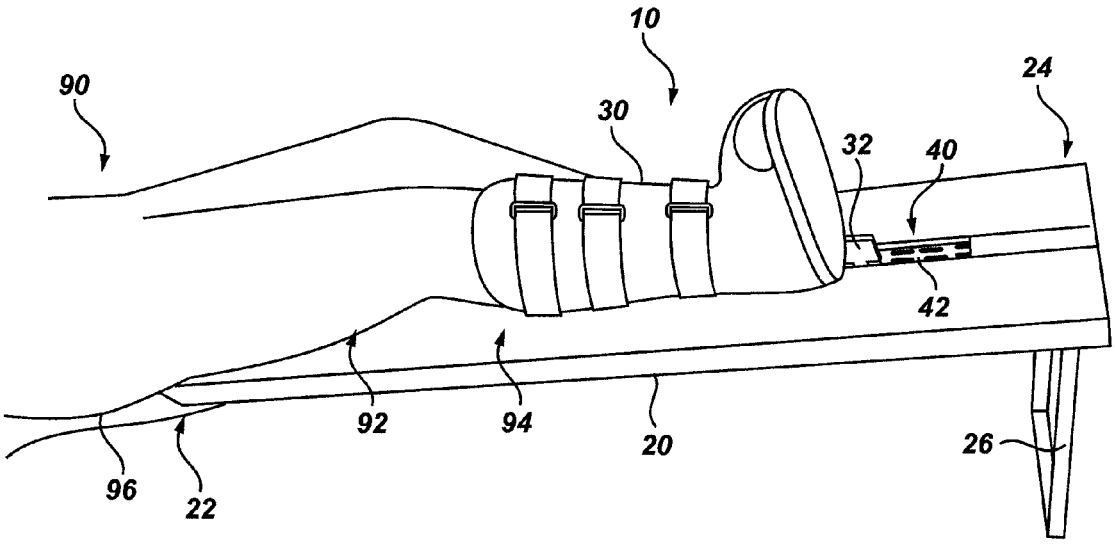
FIG. 5 is a top perspective view of person using a hip traction device in accordance with an embodiment of the present invention.

With reference to FIG. 5, shown is an illustration of a subject 90 interfacing with a traction device 10. For example, a method of tractioning a hip of a subject 90 may comprise providing a traction device 10 and attaching a body coupling mechanism 30 to a lower portion 94 of the subject's leg 92. The method may further comprise engaging a proximal end 22 of a base 20 with the subject's buttocks 96, wherein a portion of the subject's weight in the buttocks 96 may be carried by the proximal end 22 of the base 20. The base 20 may be held in place on a support surface, at least in part, by a user's weight. The engagement of the proximal end 22 of the base 20 and the user's buttocks 96 may be configured to prevent the user's buttocks 96 from moving toward the distal end 24 of the base 20 due to tension in the leg 92. Further, the method may comprise straightening the subject's leg 92 and then aligning the subject's leg 92 with the proximal 22 and distal 24 ends of the base 20. Additionally, the method may comprise attaching the body coupling mechanism 30 to a carrier 40 and activating a tensioner 60 to provide a force to move the carrier 40 toward the distal end 24 of the base 20, causing the subject's leg 92 to be put in tension. The method may further comprise deactivating the tensioner 60 to reduce the force provided to the carrier 40, allowing the carrier 40 to move toward the proximal end 22 of the base 20 and causing the subject's leg 92 to be relieved of tension. In one embodiment, activating the tensioner 60 and deactivating the tensioner 60 may be carried out according to a duty cycle. In executing the duty cycle, activating the tensioner 60 may comprise providing a force for a predetermined duration and deactivating the tensioner 60 may comprise reducing the force for a predetermined duration.

A user 90 is only attached to a traction device 10 at a single location—the leg (specifically, in this embodiment, the lower leg 94). There is no attachment between the user 90 and the traction device 10 anywhere else. The user's buttocks 96 engage the traction device 10 in a manner that prevents slipping toward the distal end of the base 20, but there is no attachment between the buttocks 96, hips, or any other part of a user 90 that is located near the proximal end 22 and the traction device 10. Thus, a traction device 10 may be used to traction a hip of a user 90 by attaching only to the lower leg 94 of the user 90.

With reference to FIGS. 6-9, illustrated are several views of an embodiment of a portable traction device 110. A portable traction device 110 may include any or all of the components discussed above pertaining to a traction device 10 in FIGS. 1-5. Certain other features may be incorporated in a portable traction device 110 to enhance portability. For example, in an embodiment of a portable traction device 110 illustrated in FIGS. 6-9, the portable traction device 110 may include a cover 14.

In one aspect, a cover 14 can include a top cover 16 and a bottom cover 18. As shown in FIGS. 6-9, the base 20 can be integrated with the top cover 16. In other words, the top cover 16 can configured to serve as the base 20, which mates with the bottom cover 18 to provide protection for the portable traction device 110 during transit. In an alternate example, not shown, the top cover and the base can be separate components, wherein the top cover can be configured to completely or partially cover the base. It should be recognized that the top cover 16, in any embodiment, can be attachable to the bottom cover 18 by a removable or permanent coupling such as a hinge, clip, buckle, strap, etc. Unless otherwise specified, any discussion of a base 20 can be understood as a base 20 being optionally integrated with the top cover 16.

The traction device 110 may include a bottom cover 18 to protect or shield components during transit that may be located on an underside of a base 20 such as a tensioner 60, guide 50, pump 62 or 64, controller 70, carrier return mechanism 50, etc. When a traction device 110 is configured for transit or storage, a bottom cover 18 may be adapted to enclose, completely or partially, an underside of a base 20. In this configuration, a base 20 may lay substantially flat relative to a bottom cover 18 to reduce or minimize the size of traction device 110 for transit or storage. To facilitate transit, the top cover 16 and/or the bottom cover 18 may include handles, straps, wheels, rollers, etc. In one embodiment, the top cover 16 and/or the bottom cover 18 can include a retractable handle.

Figure 6:
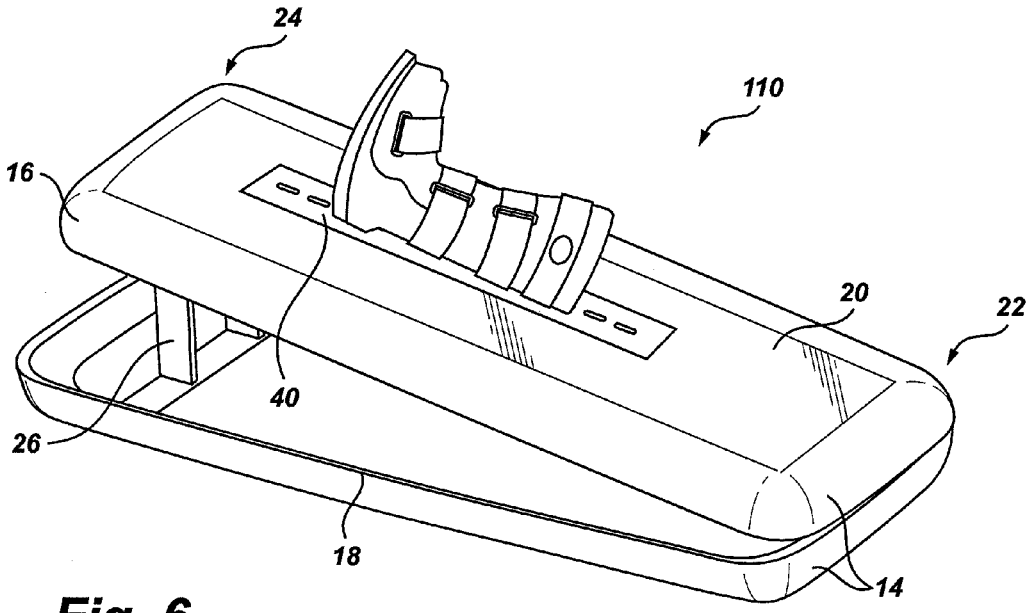
FIG. 6 is a top perspective view of a hip traction device in accordance with an embodiment of the present invention.
Figure 7:
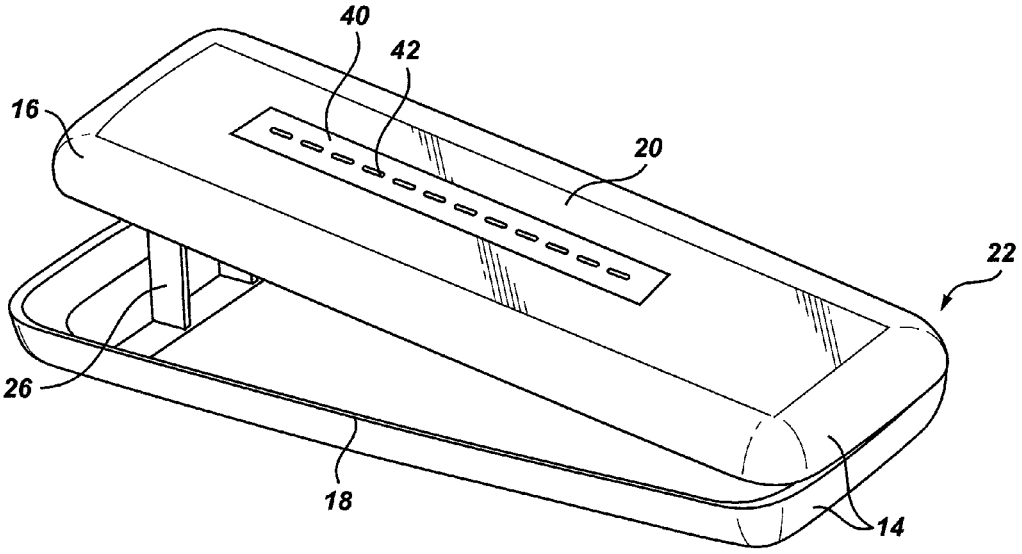
FIG. 7 is a top perspective view of a hip traction device (body coupling mechanism not shown) in accordance with an embodiment of the present invention.
Figure 8:
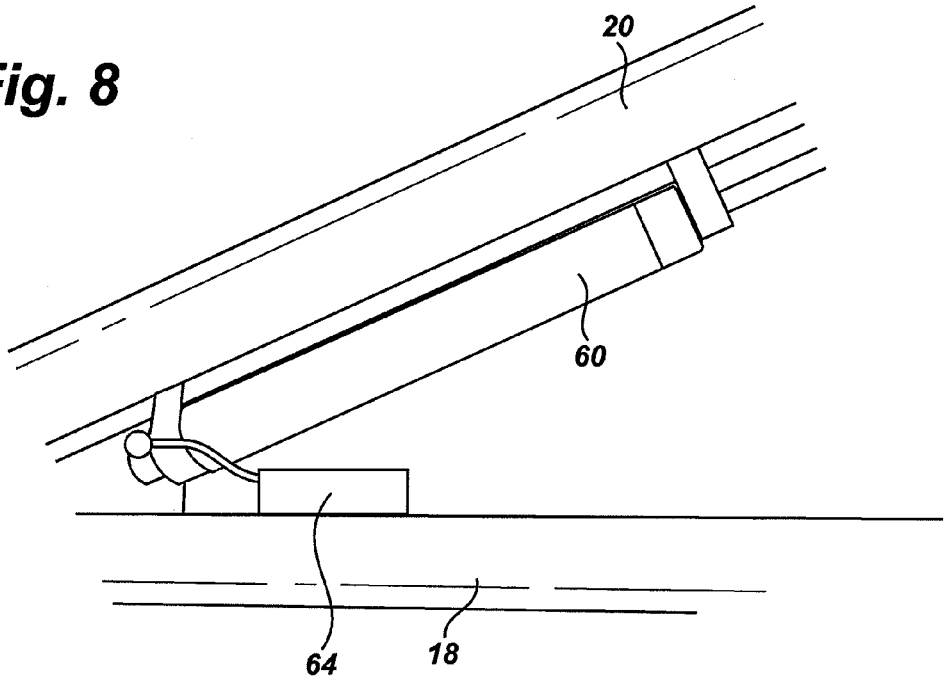
FIG. 8 is a close-up of a side view of a tensioner of a of a hip traction device in accordance with an embodiment of the present invention.
Figure 9:
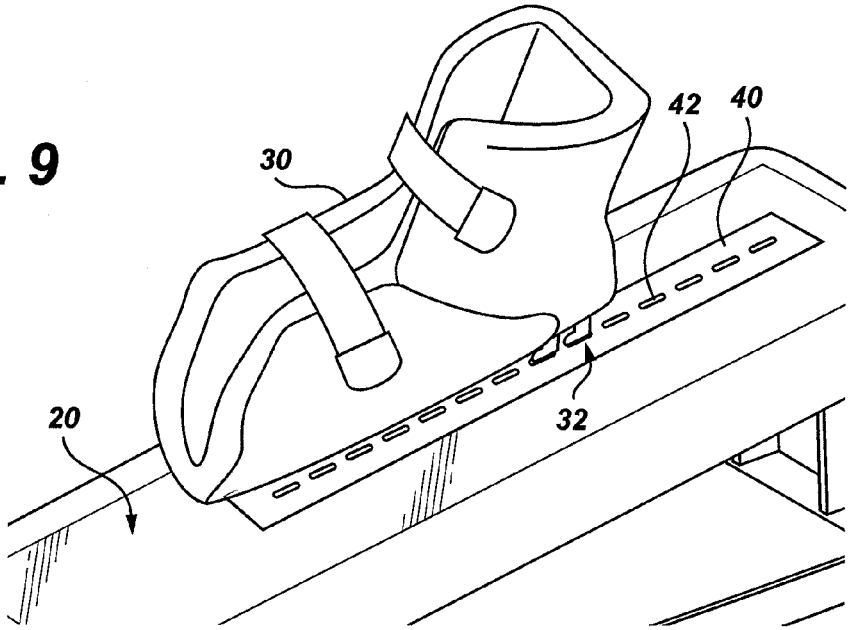
FIG. 9 is a close-up perspective view of a body coupling mechanism attached to a carrier of a hip traction device in accordance with an embodiment of the present invention.

When a traction device 110 is configured for use, as illustrated in FIG. 6, a base 20 may be configured to provide an angle relative to a bottom cover 18 that results in a suitable hip flexion angle for a user. When configured for use, a bottom cover 18 may be attached to a proximal end 22 of a base 20. This attachment may be permanent or removable and/or rotatable or fixed. For example, in one embodiment, a base 20 may be removed from a bottom cover 18 and reattached at a preset angle of attachment in a cantilevered configuration, with or without a support structure 26 at a distal end 24 of the base 20 to provide additional support. In another example, a base 20 may have a hinged attachment to a bottom cover 18. In an alternative embodiment, a base 20 may be resting on (not attached to) a bottom cover 18 in a manner that prevents slipping. A base 20 and/or a bottom cover 18 may have features or material that prevent slipping between them.

A bottom cover 18 may be incorporated into, or configured to work with, a base support structure 26 of a portable traction device 110. Thus, a bottom cover 18 may be configured to rest on a support surface and provide a support for a traction device 110 while in use. A side of a bottom cover 18 configured to contact a support surface may have friction enhancing features to prevent sliding on the surface, such as friction enhancing material or friction enhancing surface geometry.

Of course, it is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements. Thus, while the present invention has been described above with particularity and detail in connection with what is presently deemed to be the most practical and preferred embodiments of the invention, it will be apparent to those of ordinary skill in the art that numerous modifications, including, but not limited to, variations in size, materials, shape, form, function and manner of operation, assembly and use may be made without departing from the principles and concepts set forth herein.

What is claimed is:

1. A hip traction device comprising:

a base having a proximal end that engages a user's buttock and a distal end;

a guide coupled to the base that defines an axis of motion in-line with the proximal end of the base that engages the user's buttock;

a carrier configured to move along the guide in the axis of motion;

a tensioner coupled to the base and configured to provide a force to the carrier to move the carrier toward the distal end of the base; and a single body coupling mechanism attached to the carrier and being configured to attach securely to a portion of a user's leg, wherein when the user's buttock is engaged with the proximal end of the base and the user's leg is attached to the carrier via the body coupling mechanism, movement of the carrier toward the distal end of the base creates tension in the user's leg that tractions the user's hip.

2. The traction device of claim 1, further comprising a cover to protect the hip traction device during transit that at least partially encloses an underside of the base.

3. The traction device of claim 2, wherein the cover comprises a top cover and a bottom cover.

4. The traction device of claim 3, wherein the top cover is integrated with the base.

5. The traction device of claim 1, wherein the tensioner comprises a pneumatic cylinder.

6. The traction device of claim 5, wherein the tensioner further comprises a pump to pressurize the pneumatic cylinder.

7. The traction device of claim 6, wherein the pump is a hand pump.

8. The traction device of claim 6, wherein the pump is an electric pump.

9. The traction device of claim 8, further comprising a controller configured to execute a duty cycle by controlling at least one of a force amount and a duration provided by the tensioner to the carrier.

10. The traction device of claim 1, wherein tensioner comprises a hydraulic cylinder.

11. The traction device of claim 1, further comprising a controller configured to execute a duty cycle by controlling at least one of a force amount and a duration provided by the tensioner to the carrier.

12. The traction device of claim 1, wherein the body coupling mechanism comprises a bracket for removably attaching to the carrier, and further wherein the carrier comprises a receiving portion configured to engage with the bracket for removably attaching to the body coupling mechanism.

13. The traction device of claim 12, wherein the bracket comprises a hook and the receiving portion comprises a catch configured to engage with the hook.

14. The traction device of claim 12, wherein the receiving portion comprises a hook and the bracket comprises a catch configured to engage with the hook.

15. The traction device of claim 1, wherein the tensioner provides the force to the carrier via a member in compression.

16. The traction device of claim 1, wherein the tensioner provides the force to the carrier via a member in tension.

17. The traction device of claim 1, wherein the portion of a leg to be securely attached comprises a foot, ankle, shin, and calf, or combination thereof, and further wherein the body coupling mechanism comprises a boot or sleeve configured to attach securely to the foot, ankle, shin, and calf, or combination thereof.

18. The traction device of claim 1, wherein the force provided by the tensioner to the carrier is limited to a predetermined maximum force.

19. The traction device of claim 1, wherein the force provided by the tensioner to the carrier is adjustable.

20. The traction device of claim 1, wherein the engagement of the proximal end of the base and the user's buttocks is configured to prevent the user's buttocks from moving toward the distal end of the base due to tension in the leg.

21. The traction device of claim 1, wherein the base is held in place on a support surface, at least in part, by a user's weight.

22. The traction device of claim 1, wherein a portion of the base in contact with a support surface comprises friction-enhancing features.

23. The traction device of claim 1, wherein the base is at an angle of between 0 and 45 degrees relative to a support surface for a user of the traction device.

* * * * *